US011871817B2

(12) United States Patent
Pan

(10) Patent No.: US 11,871,817 B2
(45) Date of Patent: Jan. 16, 2024

(54) BUCKLE LOCK

(71) Applicant: Sinox Co., LTD., New Taipei (TW)

(72) Inventor: Kuo-Kuang Pan, New Taipei (TW)

( * ) Notice: Subject to any disclaimer, the term of this patent is extended or adjusted under 35 U.S.C. 154(b) by 0 days.

(21) Appl. No.: 17/692,127

(22) Filed: Mar. 10, 2022

(65) Prior Publication Data

US 2022/0287417 A1 Sep. 15, 2022

(30) Foreign Application Priority Data

Mar. 12, 2021 (TW) ..... 110202673

(51) Int. Cl.
*A44B 11/25* (2006.01)

(52) U.S. Cl.
CPC ..... *A44B 11/2573* (2013.01); *A44B 11/2507* (2013.01)

(58) Field of Classification Search
CPC ..... A44B 11/2573; A44B 11/2507; E05B 37/0034; Y10T 70/7147
See application file for complete search history.

(56) References Cited

U.S. PATENT DOCUMENTS 5,117,663 A * 6/1992 Ida ..... A44B 11/263 70/64
5,485,734 A * 1/1996 Yang ..... E05B 37/0034 70/285
5,692,403 A * 12/1997 Ling ..... E05B 37/02 70/57
6,883,354 B1 * 4/2005 Yu ..... E05B 37/02 70/284
7,104,095 B1 * 9/2006 Lin ..... A44B 11/2573 70/284
7,490,876 B2 * 2/2009 Kihara ..... E05B 65/50 292/341.12
7,568,367 B2 * 8/2009 Huang ..... E05B 37/0034 70/284
2004/0226323 A1 * 11/2004 Ling ..... E05B 37/0034 70/284
2006/0207301 A1 * 9/2006 Yu ..... E05B 37/025 70/284
2006/0207302 A1 * 9/2006 Yu ..... E05B 65/5284 70/58
2006/0272368 A1 * 12/2006 Yu ..... E05B 67/003 70/58
2007/0084256 A1 * 4/2007 Wu ..... E05B 65/50 70/58
2007/0175247 A1 * 8/2007 Yu ..... E05B 37/0034 70/58
2018/0279724 A1 * 10/2018 Davis ..... A44B 11/2549
2019/0085598 A1 * 3/2019 Lai ..... E05C 1/14

* cited by examiner

*Primary Examiner* — Robert Sandy
*Assistant Examiner* — Rowland Do
(74) *Attorney, Agent, or Firm* — Bruce Stone LLP; Joseph A. Bruce

(57) ABSTRACT

The present invention provides a buckle lock includes a lock member and a buckle base which are able to be inserted and locked to each other. The buckle base includes a lock portion and a release button, and the lock portion includes at least one locking mechanism. It is characterized in that when the locking mechanism is in a locked state, the lock member can still be inserted into the buckle base and the lock connection is completed immediately after completing the locking action.

9 Claims, 11 Drawing Sheets

BUCKLE LOCK

BACKGROUND

Technical Field

The Present invention is related to a buckle lock mainly comprising a lock member and a buckle base. Particularly, a buckle lock that when the locking mechanism is in a locked state, the lock member can still be inserted into and connected to the buckle base, and the locking action is automatically completed.

Description of Related Art

Due to the anti-theft requirements for different products, various locks have emerged, such as luggage locks, bicycle locks, computer locks, and so on. Taking luggage locks as an example, the types of locks include at least a luggage lock provided on the trunk body and a strap lock used to restrain the luggage.

The buckle lock is a lock that includes two lock units that can be buckled with each other or insert a lock unit into the lock mechanism. At present, the existing buckle lock design requires a lock mechanism (such as a combination lock or key lock) be in the unlocked state in order to allow the two lock units that were originally inserted or buckled to be able to detach with each other. Similarly, when wanted to relock the two lock units, the user must also set all the codes on the combination lock correctly or keep the key lock in the unlocked state, the two lock units of the lock can then be inserted or buckled together. Furthermore, the combination lock needs to set to a random code after completing the locking action, or the key lock is turned to a locked position with the key, then action of locking the two lock units could be completed accordingly.

It can be found that when the two lock units of the buckle lock are to be re-locked, there is indeed room for improvement in operation. In addition, because the lock equipped with a combination lock also requires the user to set the correct code before it can be locked, as a result, the code or password may be spied on by someone with intentions.

SUMMARY

In view of above, the present invention provides a buckle lock. The main purpose of the present invention is to provide a buckle lock that can be operated more easier and quicker when locking, and does not need to set the correct code or password before locking.

In order to achieve the above-mentioned purpose, the present invention provided a buckle lock characterized in that when the locking mechanism is in a locked state, the two lock units of the lock can still be insert or plugged into each other and the lock connection is completed immediately after completing the locking action.

According to the definition of the present application, it is provided a buckle lock including: A buckle lock, comprising:

a lock member having with an insert portion;

a buckle base configured with a slot for receiving the insert portion;

a lock portion having at least a lock mechanism configured on the buckle base, wherein the locking mechanism is changeable between a locked state and an unlocked state; and a release button configured on the buckle base, pushed by a first elastic member to maintain in an ejected position, and is pressable to move to a push-down position; wherein the insert portion of the lock member is able to be inserted into the slot of the buckle base to form a connection, when the locking mechanism is in the unlocked state, the release button is pressed to the push-down position to release the connection between the lock member and the buckle base, and when the locking mechanism is in the locked state, the insert portion can still be inserted into the slot and be locked immediately after completing the insertion action.

In some embodiments, the present invention provides a buckle lock. When the locking mechanism is in the locked state, the lock member and the buckle base can still be inserted and connected to each other to complete the locking action. In the other words, under the condition that the combination lock is not set to the correct code or password, or when the key is in the locked position, the lock member and the buckle base are locked synchronously after completing the insert action.

In some embodiments, the present invention provides a buckle lock further includes a movable latch having a linkage with the release button. The movable latch is pushed by a second elastic member and is normally maintained at a lock position for limiting the insert portion, and able to be moved to an unlock position when the insert portion is released from limiting.

In some embodiments, the present invention provides a hole for limiting the movable latch is configured with the insert portion.

In some embodiments, the buckle base is provided with a positioning block located on a channel of the slot in the present invention. The positioning block has a linkage with the movable latch and is pushed by a third elastic member and kept in a push-out position. The positioning block is also movable to a retracted position by connecting the insert portion inserted in the slot. When the positioning block is in the push-out position, the movable latch is kept in the unlock position against the positioning block. Therefore, when the positioning block is in the retracted position, the movable latch is pushed and moved to the lock position by the second elastic member.

In some embodiments, when the lock mechanism is in the unlocked state, the release button is pressed to move to a push-down position, and the movable latch can be moved to the unlock position in conjunction with the release button.

In some embodiments, the locking mechanism is a combination lock mechanism or a key lock mechanism, or includes a combination lock mechanism and a key lock mechanism at the same time. Wherein the combination lock mechanism includes a movable plate which has abutting relationship with the release button. When the combination lock mechanism is in the locked state, the movable plate is located at the first position where the release button cannot be pressed and moved, When the combination lock mechanism is in an unlocked state, the movable plate moves to a second position that allows the release button to be pressed and moved. The key lock mechanism includes a cam portion that has a linkage relationship with the movable latch. When the key lock mechanism changes from the locked state to the unlocked state, the cam portion will move accordingly and the movable latch will be move from the lock position to the unlock position.

In some embodiments, in the present invention the buckle lock is applied on suitcase to become a suitcase lock.

In some embodiments, the buckle lock can be used in conjunction with a connecting piece to form a bicycle lock or a belt lock; the connecting piece includes but is not limited to a bar, a steel cable or a webbing.

The detailed features and advantages of the present invention will be described in detail in the following embodiments, and the content is sufficient to enable anyone familiar with the relevant art to understand the technical content of the present invention and implement it accordingly, and according to the content disclosed in this specification and the scope of patent application With the drawings, anyone who is familiar with the relevant art can easily understand the purpose and advantages of the present invention.

DESCRIPTION OF THE EMBODIMENTS

Figure 1:
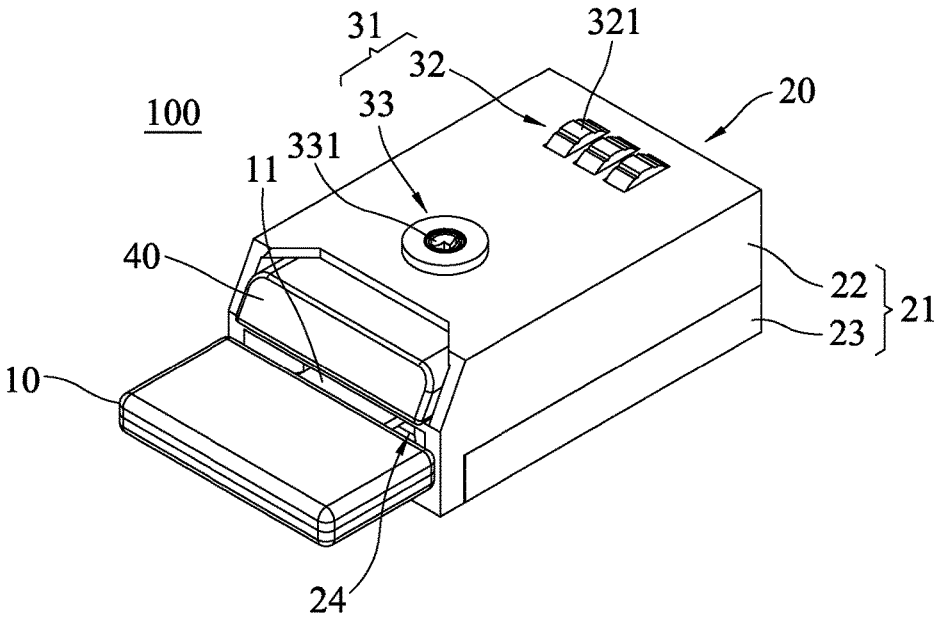
FIG. 1 is a perspective view of the lock member of the buckle lock being inserted and connected to the buckle base according to the present invention.
Figure 2:
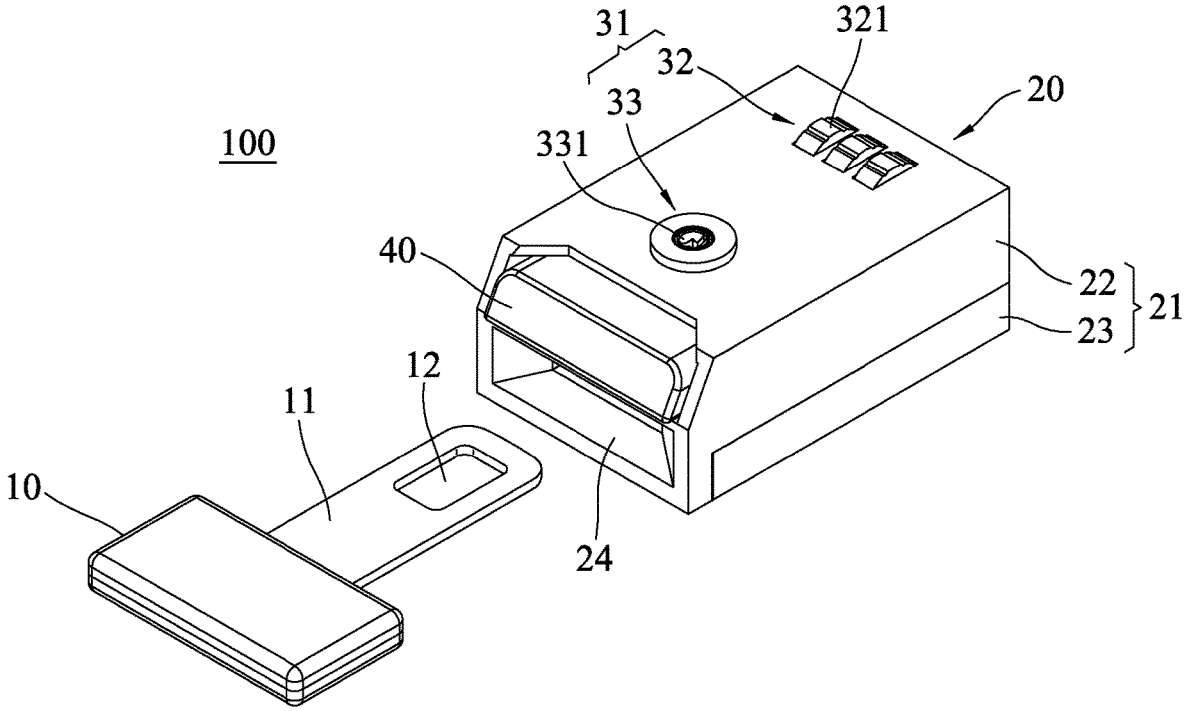
FIG. 2 is a perspective view of the lock member of the buckle lock being disengaged from the buckle base according to the present invention.
Figure 3:
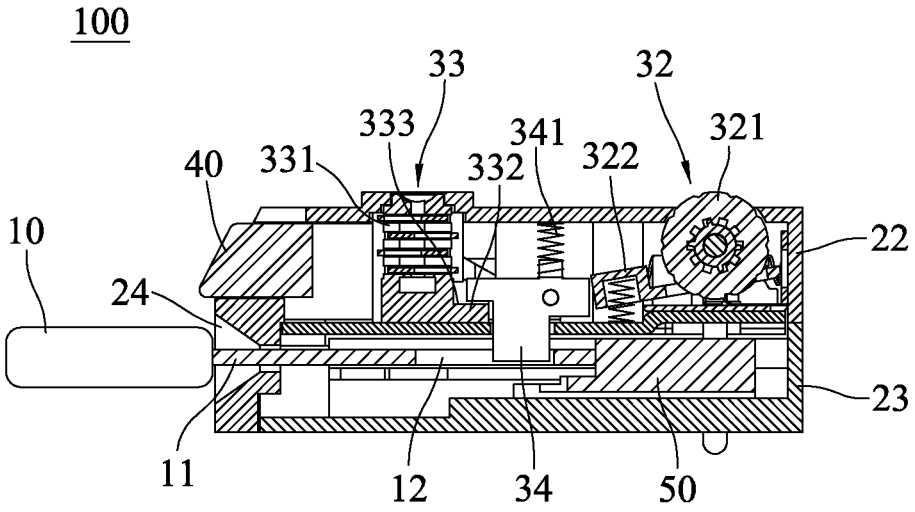
FIG. 3 is a cross-sectional schematic view of the lock member of the buckle lock being inserted and connected to the buckle base according to the present invention.
Figure 4:
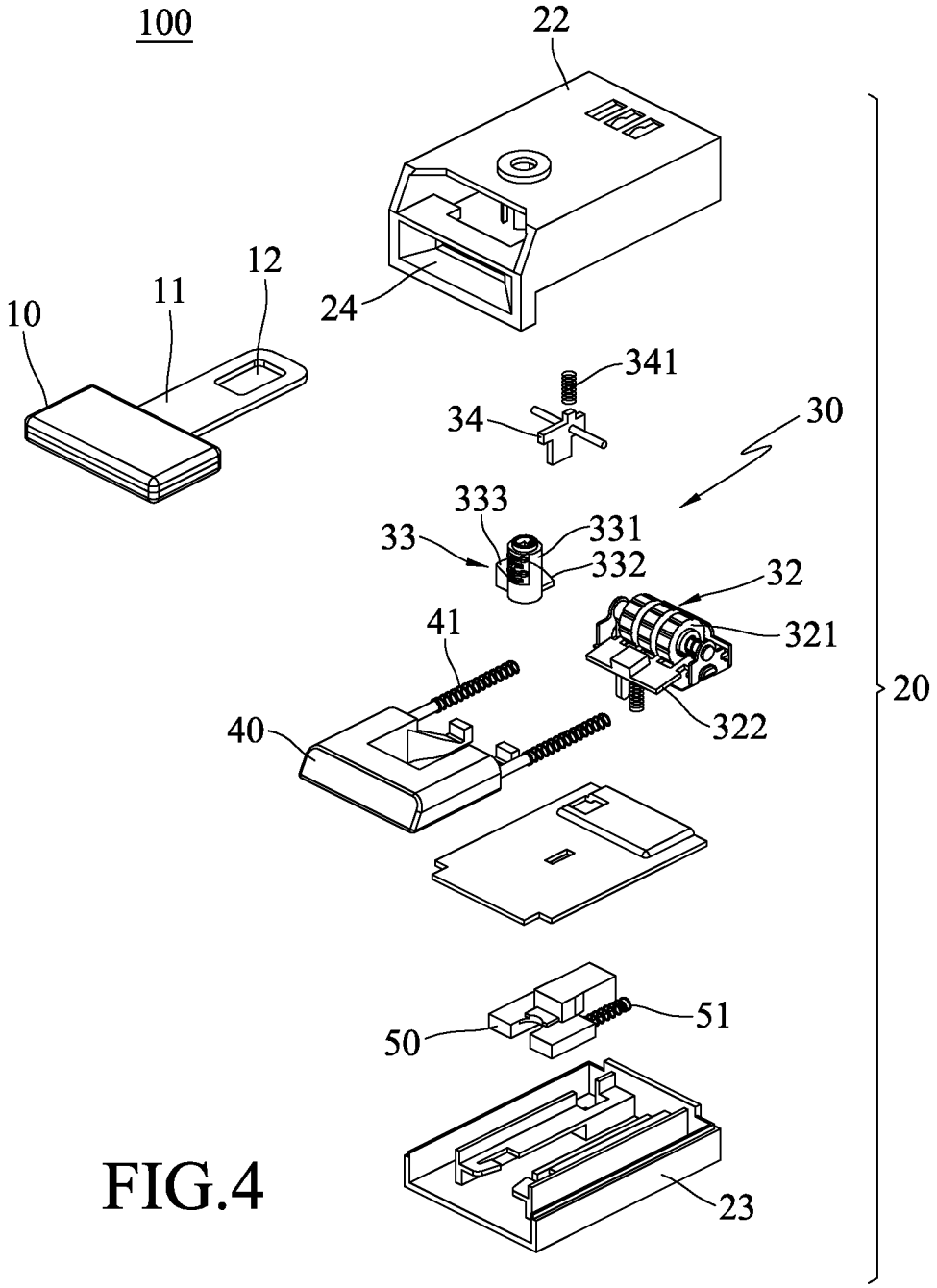
FIG. 4 is an exploded perspective view of the buckle lock of the present invention.

It should be noted that when an element is referred to as being "fixed to" another element, it can be directly on the other element or a central element may also exist. When an element is considered to be "connected" to another element, it can be directly connected to the other element or an intermediate element may also exist. The terms "vertical", "horizontal", "left", "right" and similar expressions used herein are for illustrative purposes only, and do not mean it is the only implementation.

Unless otherwise defined, all technical and scientific terms used herein have the same meaning as commonly understood by those skilled in the technical field of the present invention. The terms used in the specification of the present invention herein are only for the purpose of describing specific embodiments and are not intended to limit the present invention. The term "and/or" as used herein includes any and all combinations of one or more related listed items.

As shown in FIG. 1 to FIG. 4, the present invention provides a buckle lock 100. The buckle lock 100 mainly includes a lock member 10 and a buckle base 20 that is able to be inserted and locked to each other. In addition, a lock portion 30 and a release button 40 are included on the buckle base 20.

As shown in the figure, the lock member 10 has an insert portion 11, and a hole 12 is on the insert portion 11.

The buckle base 20 has a lock housing 21, the lock housing 21 comprises an upper cover 22 and a bottom cover 23, used to carry the locking portion 30 and the release button 40, and a slot 24 for receiving the insert portion 11 is formed on the lock housing 21 of the buckle base 20. Under above combination, the insert portion 11 of the lock member 10 is able to be inserted into the buckle base 20 through the slot 24, and after the locking portion 30 is added to the lock, the locking member 10 and the buckle base 20 is able to be locked and connected accordingly. To detach the lock member 10 and the buckle base 20, the user can first unlock the insert portion 11 from the locking portion 30, and then press the release button 40 to release the insert portion 11 of the lock member 10 out of the buckle base 20, or just exit out of the buckle base 20 immediately after unlocking the insert portion 11 from the locking member 30.

The locking portion 30 includes at least one locking mechanism 31 arranged on the buckle base 20, and the locking mechanism 31 is changeable into a locked state or an unlocked state through operation. In implementation, the type of the locking mechanism 31 includes, but is not limited to, a combination lock mechanism 32 or a key lock mechanism 33, the locking mechanism 31 is able to adopt a single lock mechanism design, that is, a combination lock mechanism 32 or a key lock mechanism 33 is provided on the buckle base 20. In addition, as disclosed in this embodiment, the design of two locking mechanisms 31 can also be adopted, that is, a combination lock mechanism 32 and a key lock mechanism 33 are provided on the buckle base 20 at the same time. In this way, the user can choose to use the combination lock mechanism 32 or the key lock mechanism 33 for unlocking and locking operations.

The release button 40 is configured on the buckle base 20, pushed by a first elastic member 41 to maintain in an ejected position, and is pressable to move to a push-down position.

Wherein, the insert portion 11 of the lock member 10 is able to be inserted into the slot 24 of the buckle base 20, when the lock mechanism 31 is in the unlocked state, the release button 40 can be pressed to the push-down position to release the connection state between the lock member 10 and the buckle base 20 to form a connection, and when the locking mechanism 31 is in the locked state, the insert portion 11 is still be inserted into the slot 24 and be locked immediately after completing the insertion action.

In some embodiments, the present disclosure provides a locking portion 30 further including a movable latch 34. The movable latch 34 is pushed by a second elastic member 341 and is normally maintained at a lock position for limiting the insert portion 11, and able to be move to an unlock position when the insert portion 11 is released from limiting.

In addition, in some embodiments, the buckle base 20 is provided with a positioning block 50 located on a channel of the slot 24 in the present invention. The positioning block has a linkage with the movable latch 34 and is pushed by a third elastic member 51 and kept in a push-out position normally. The positioning block 50 is moveable to a retracted position by connecting the insert portion 11 inserted in the slot 24. When the positioning block 50 is in the push-out position, the movable latch 34 is kept in the unlock position against the positioning block 50. Therefore, when the positioning block 50 is in the retracted position, the movable latch 24 is pushed and moved to the lock position by the second elastic member 341.

With above disclosed structure, the insert portion 11 of the lock member 10 is inserted into the slot 24 of the buckle base 20, and it is able to buckle into the hole 12 on the insert portion 11 through the movable latch 34 configured on the buckle base 20 so as to connect the insert portion 11 of the lock member 10 to the slot 24 of the buckle base 20.

When the lock mechanism 31 on the buckle base 20 is in the unlocked state, after pressing the release button 40, the insert portion 11 can be released by the movable latch 34. Therefore, the insert portion 11 of the lock member 10 is automatically ejected or pulled out from the slot 24 of the buckle base 20, so that the lock member 10 and the buckle base 20 are detached from each other.

In this embodiment, the locking mechanism 31 includes a combination lock mechanism 32 and a key lock mechanism 33. The combination lock mechanism 32 and the key lock mechanism 33 can be respectively changed into a "locked state" or an "unlocked state".

The combination lock mechanism 32 includes a plurality of matching wheels 321 and a movable plate 322 that is in abutting relationship with the release button 40. When the combination lock mechanism 32 is in the locked state, that is, when any check wheel 321 has not been turned to the correct code position, the movable plate 322 will remain in the first position where the release button 40 cannot be pressed and moved. When the combination lock mechanism 32 is in the unlocked state, that is, when all the check wheels 321 are turned to the correct code position, the movable plate 322 moves to the second position that allows the release button 40 to be pressed and moved. In other words, when the combination lock mechanism 32 is in the unlocked state, the release button 40 is pressed to move to the push-down position, and the movable latch 34 can be moved to the unlock position in conjunction with the release button 40.

The key lock mechanism 33 includes a lock core 331 and a cam portion 332, the cam portion 332 has a linkage with the movable latch 34. When the lock core 331 of the key lock mechanism 33 is changed from the locked state to the unlocked state through the rotation of the key (not shown in the figure), the cam portion 332 is moved accordingly and the movable latch 34 is moved from the lock position to the unlock position.

Figure 5A:
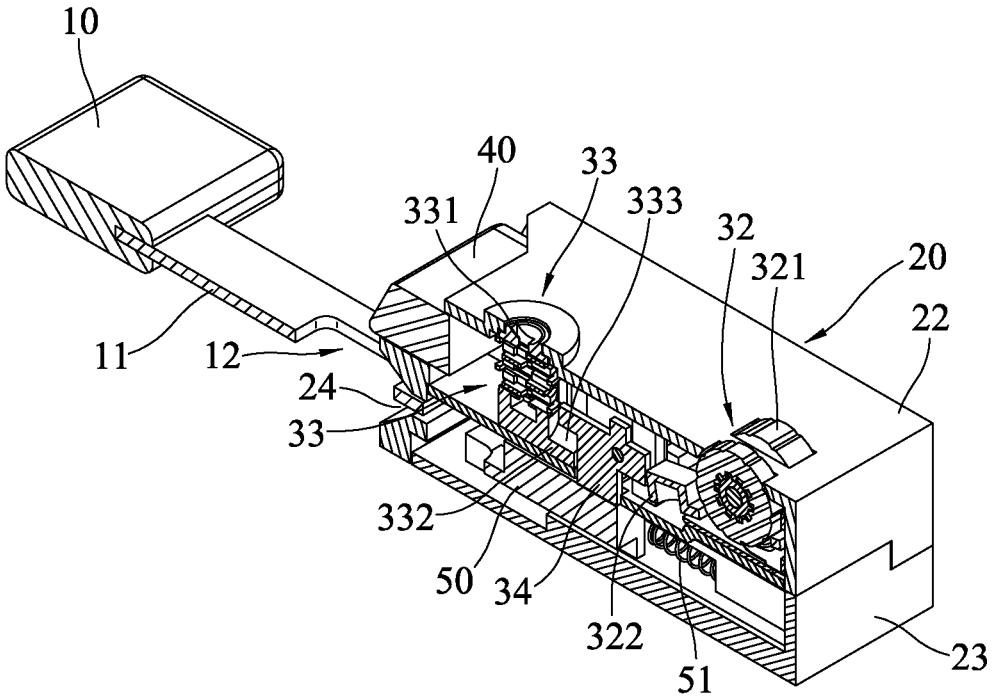
FIG. 5A is the first cross-sectional schematic diagram of the actions of inserting and locking the lock member into the buckle base, when both the combination lock mechanism and the key lock mechanism are under the locked state.
Figure 5B:
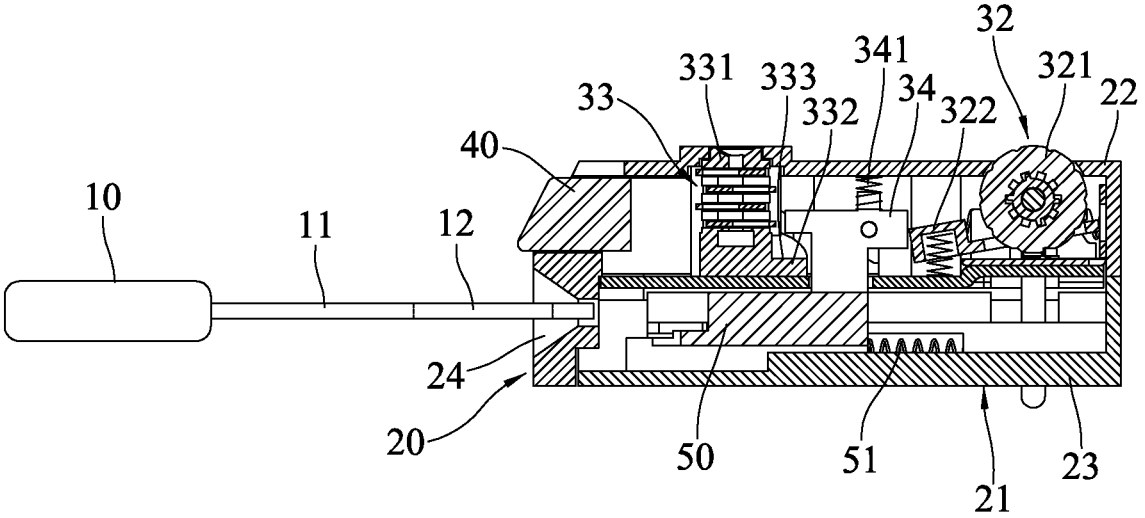
FIG. 5B is a schematic side cross-sectional view of the state disclosed in FIG. 5A.
Figure 6A:
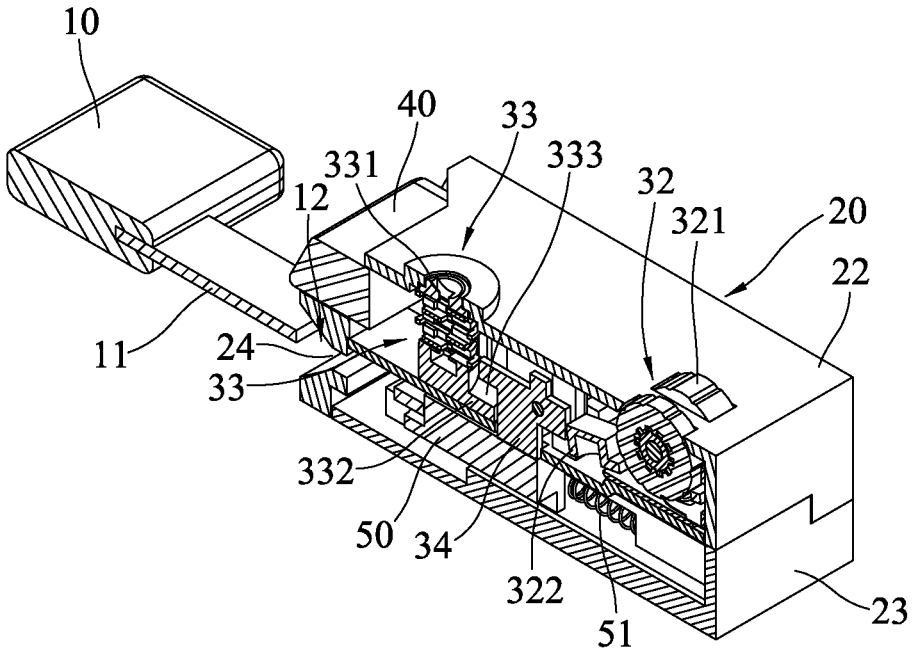
FIG. 6A is the second cross-sectional schematic diagram of the actions of inserting and locking the lock member into the buckle base, when both the combination lock mechanism and the key lock mechanism are under the locked state.
Figure 6B:
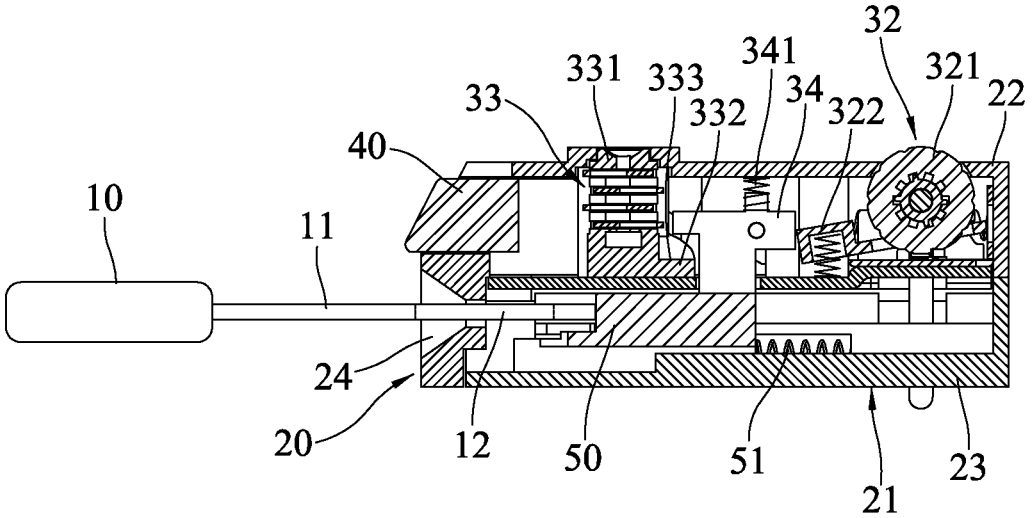
FIG. 6B is a schematic side cross-sectional view of the state disclosed in FIG. 6A.
Figure 7A:
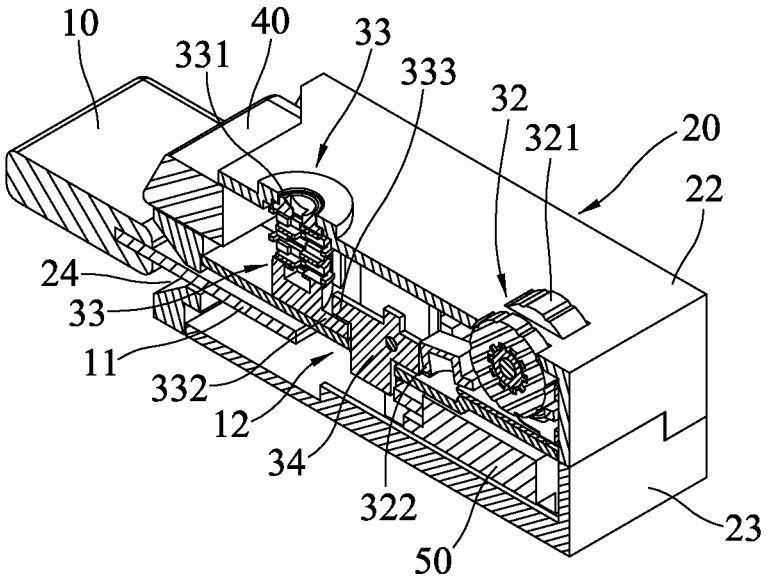
FIG. 7A is the third cross-sectional schematic diagram of the actions of inserting and locking the lock member into the buckle base, when both the combination lock mechanism and the key lock mechanism are under the locked state.
Figure 7B:
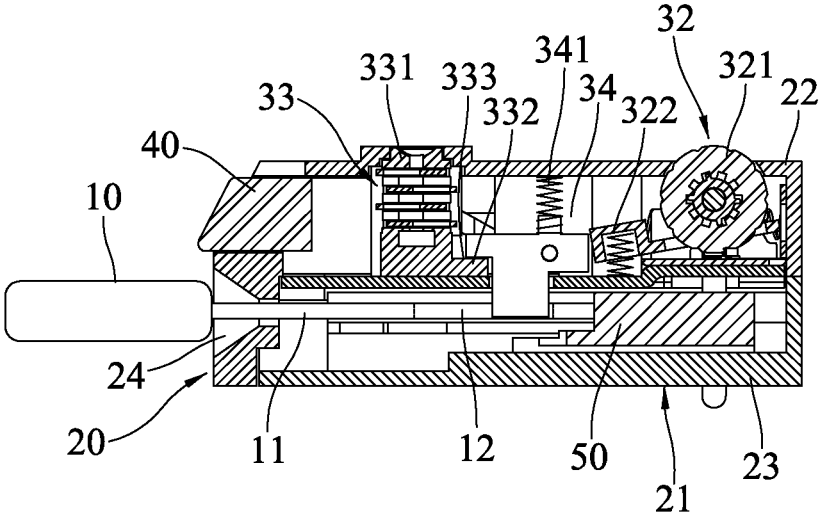
FIG. 7B is a schematic side cross-sectional view of the state disclosed in FIG. 7A.

FIG. 5A to FIG. 5B, FIG. 6A to FIG. 6B and FIG. 7B is a schematic diagram showing the exploded action of inserting and locking the lock member 10 to the buckle base 20 when the combination lock mechanism and the key lock mechanism of the present invention are both in a locked state. As shown in FIG. 5A and FIG. 5B, when the combination lock mechanism 32 and the key lock mechanism 33 are both in the locked state, the process of inserting the insert portion 11 of the lock member 10 into the slot 24 of the buckle base 20. At first, the insert portion 11 inserted into the slot 24 abuts against the front end of the positioning block 50 provided in the buckle base 20 (as shown in FIG. 6A and FIG. 6B). As the insert portion 11 continues to penetrate into the slot 24, the positioning block 50 is also be pushed synchronously and moved backward, and finally moved to a retracted position against the inner wall of the lock housing 21 (as shown in FIG. 7A and FIG. 7B). When the positioning block 50 reaches the retracted position, the movable latch 34 that originally abutted on the positioning block 50 is pushed down by the second elastic member 341 and falls into the hole 12 of the insert portion 11 in the lock position. The insert portion 11 of the locking member 10 is buckled by the movable latch 34 to be integrated into the slot 24 of the buckle base 20, and the positioning block 50 is kept in the retracted position.

To unlock the locking mechanism 31 of the movable latch 34 on the insert portion 11, one of the combination lock mechanism 32 or the key lock mechanism 33 needs to be changed into an unlocked state. The movable latch 34 moved from the lock position to the unlock position.

Figure 8A:
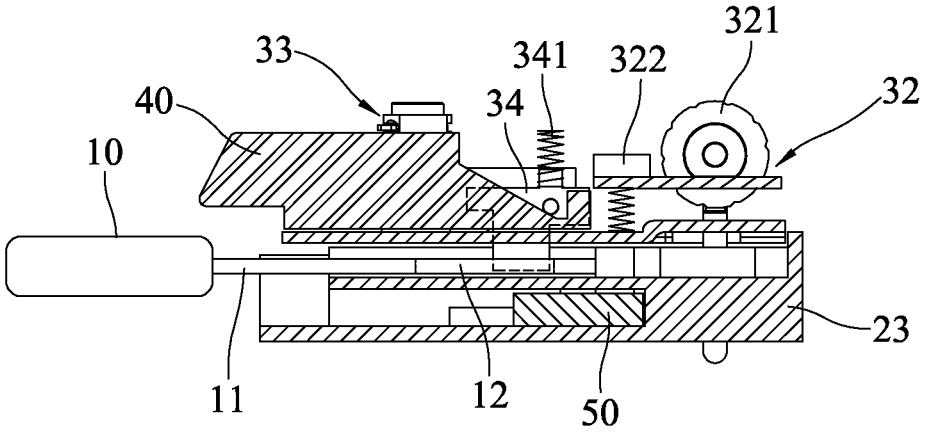
FIG. 8A to FIG. 8B are schematic diagrams of the actions of releasing the lock member from the buckle base after pressing the release button when the combination lock mechanism is changed to the unlocked state.
Figure 8B:
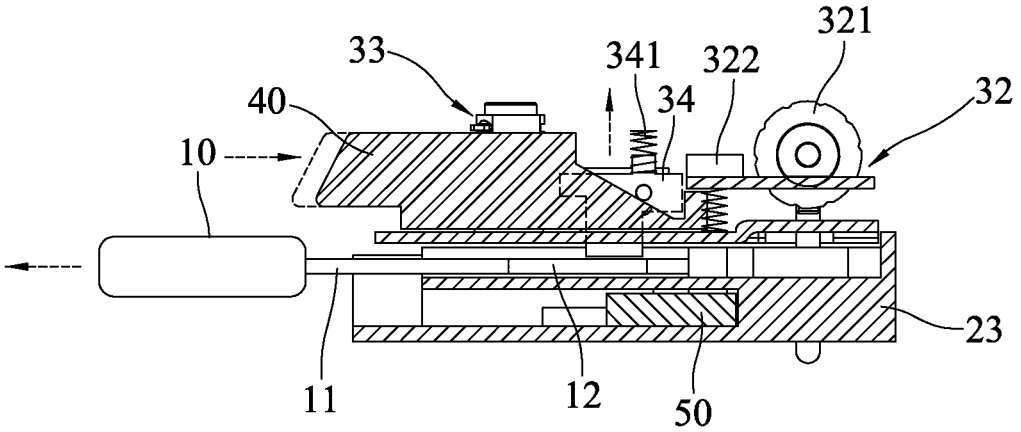
Figure 9A:
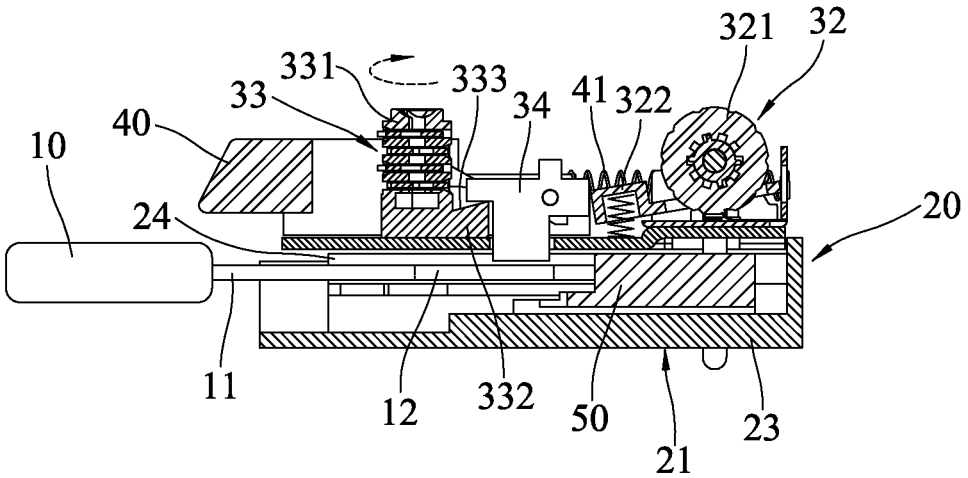
FIG. 9A is the first schematic diagram of the actions to release the lock member from the buckle base when the key lock mechanism is changed to the unlocked state.
Figure 9B:
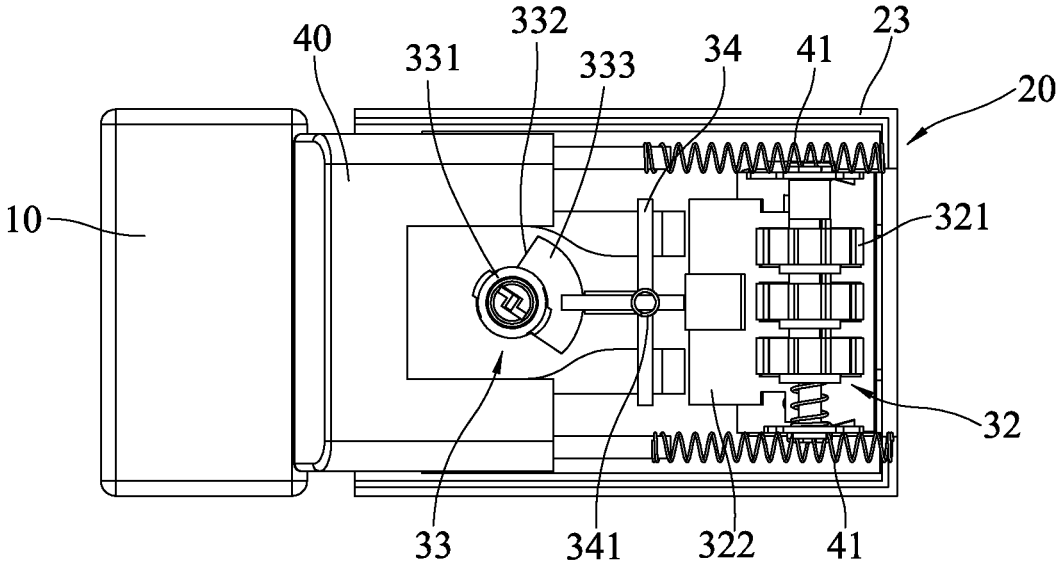
FIG. 9B is a schematic top view of the state disclosed in FIG. 9A.
Figure 10A:
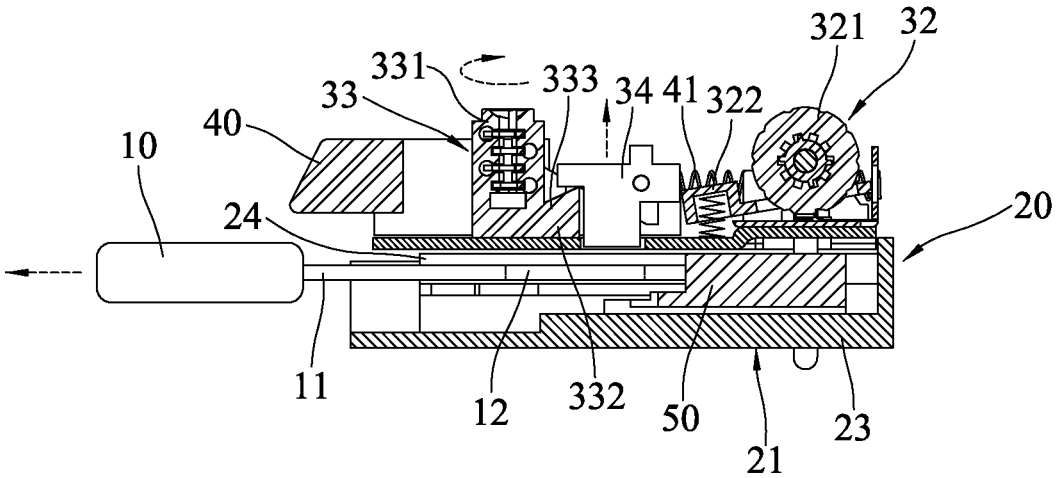
FIG. 10A is the second schematic diagram of the actions to release the lock member from the buckle base when the key lock mechanism is changed to the unlocked state.
Figure 10B:
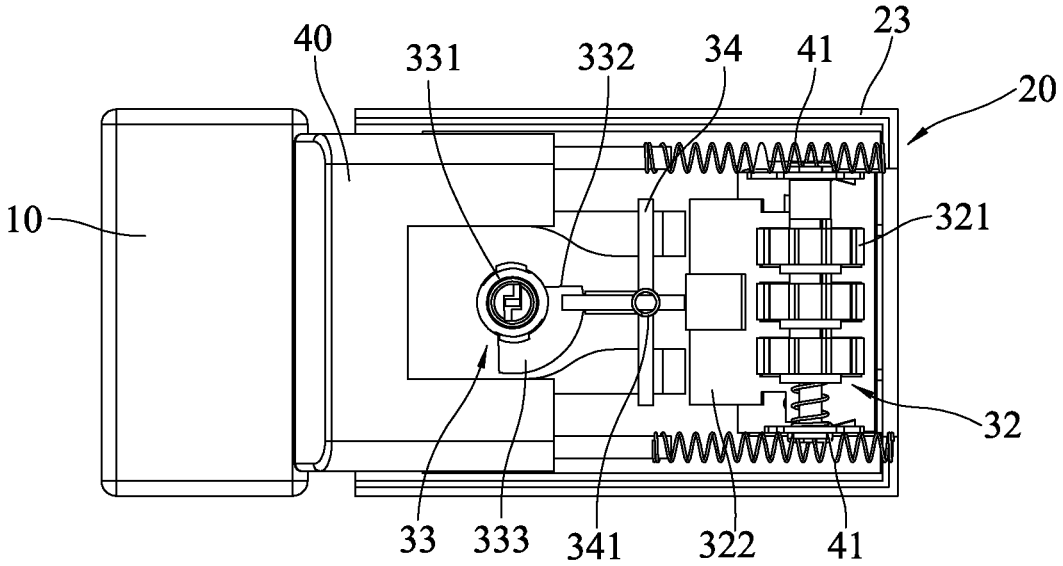
FIG. 10B is a schematic top view of the state disclosed in FIG. 10A.

The movable plate 322, which was originally in the locked state and kept at the first position where the release button 40 cannot be moved by pressing, would be moved to allow the release button 40 to be pressed to move to the second position when the combination lock mechanism 32 is transformed into the unlocked state (as shown in FIG. 8A). After the movable plate 322 is moved to the second position, the release button 40 is able to be pressed to move to the push-down position, and the movable latch 34 is able to be moved to the unlock position in conjunction with the release button 40 (as shown in FIG. 8B).

When the movable latch 34 returns to the unlock position, the insert portion 11 of the lock member 10 would be pushed out of the slot 24 of the buckle base 20 by the positioning block 50 that been released the movement restriction at the same time, and the positioning block 50 would also return to a push-out position again.

Please refer to what shown in FIG. 9A, FIG. 9B, FIG. 10A and FIG. 10B. When the lock core 331 of the key lock mechanism 33 is changed from the locked state to the unlocked state by a key rotation operation, the cam portion 332 will also move accordingly. The movable latch 34 is lifted up from the lock position by the inclined guide surface 333 on the cam portion 332, so that the movable latch 34 is in linkage to move to the unlock position.

A buckle lock 100 mainly includes a locking member 10 and a buckle base 20. The insert portion 11 of the locking member 10 can be inserted and connected in the slot 24 of the buckle base 20. When the locking mechanism 31 of the buckle base 20 is in the unlocked state, the connection relationship between the lock member 10 and the buckle base 20 is able to be released by pressing the release button 40 to the push-down position. when the locking mechanism 31 of the buckle base 20 is in a locked state, the insert portion 11 can still be inserted into the slot 24, and the locking action is automatically completed after the locking member 10 and the buckle base 20 complete the insertion action.

Figure 11:
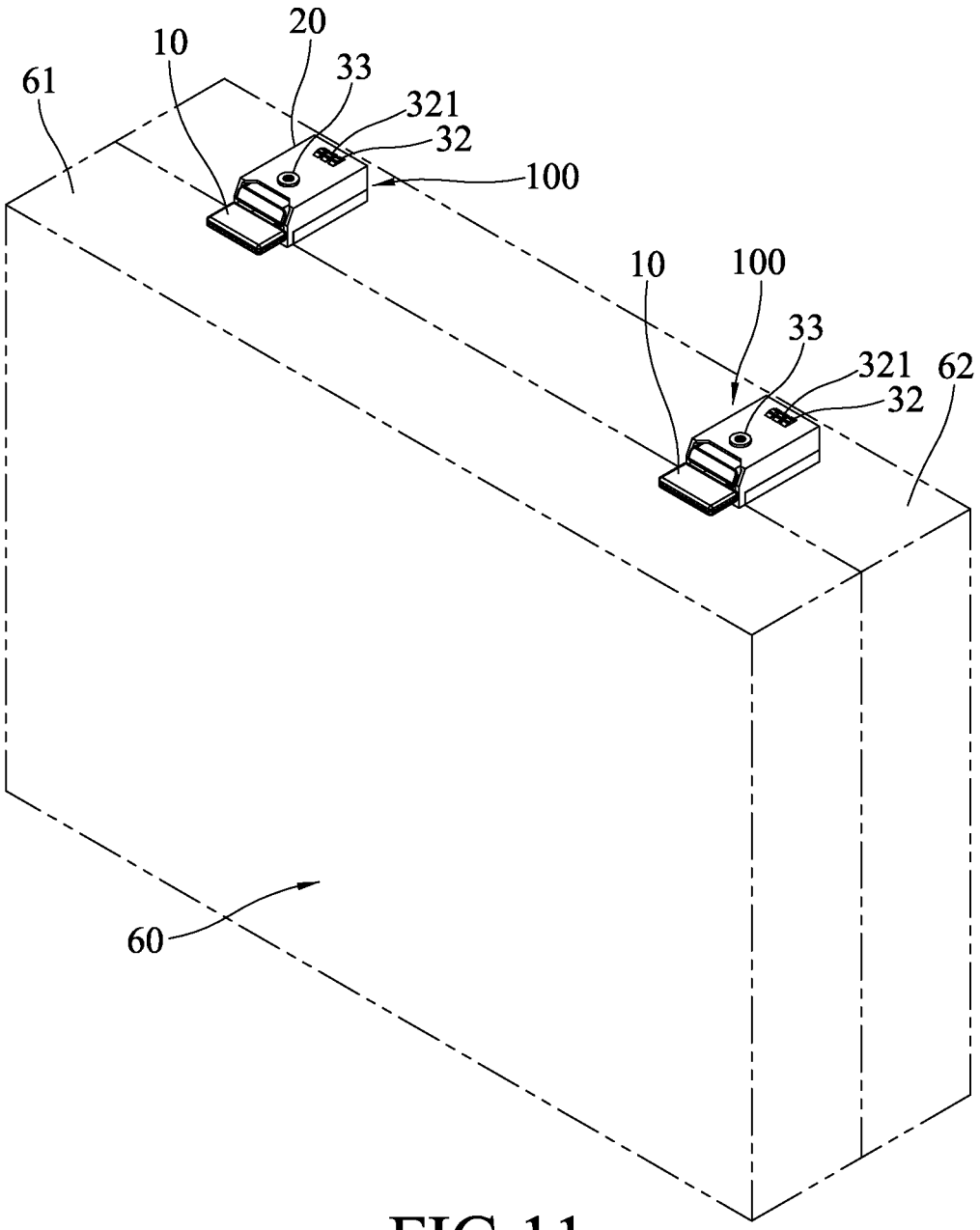
FIG. 11 is a diagram showing an embodiment of the buckle lock installed on a luggage case.

As shown in FIG. 11, on a luggage box 60 including a first box shell 61 and a second box shell 62 pivotally connected together, it is assembled as a luggage box lock. The lock member 10 is arranged on the outer surface of the first box shell 61, and the buckle base 20 is arranged on the outer surface of the second box shell 62 and is located at a position correspondingly docking with the lock member 10. When the locking mechanism 31 is in the locked state, the first box shell 61 and the second box shell 62 are closed to each other, and the insert portion 11 of the lock member 10 will be inserted into the slot 24 of the buckle base 20 simultaneously, so that the movable latch 34 is returned to the lock position, the insert portion 11 is locked, and the lock member 10 is plugged and locked with the buckle base 20.

Figure 12:
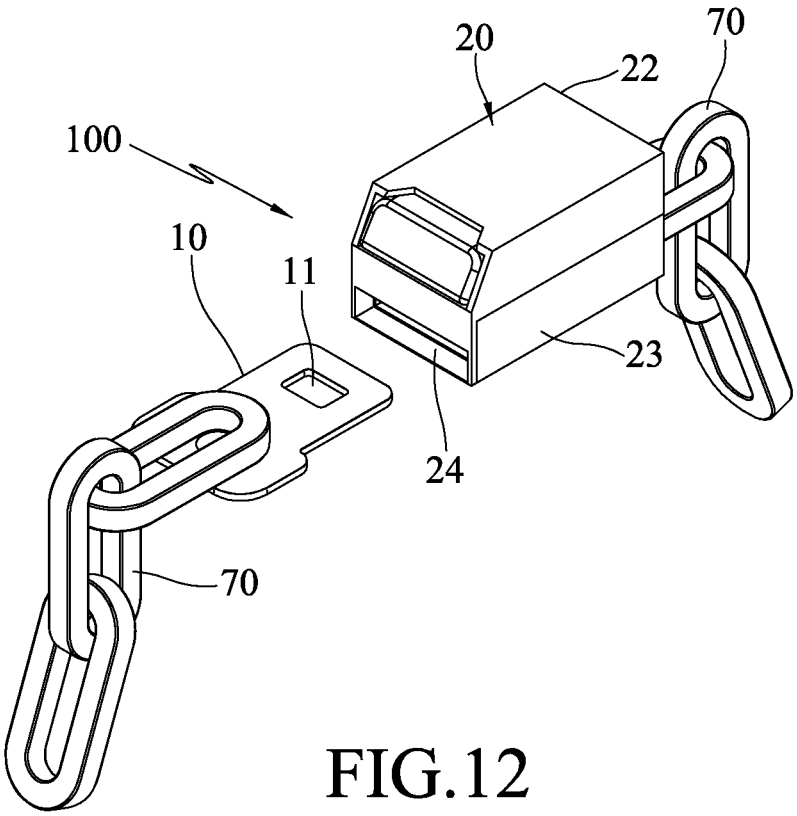
FIG. 12 is a diagram showing an embodiment of the buckle lock combined with a connecting piece.
Figure 13:
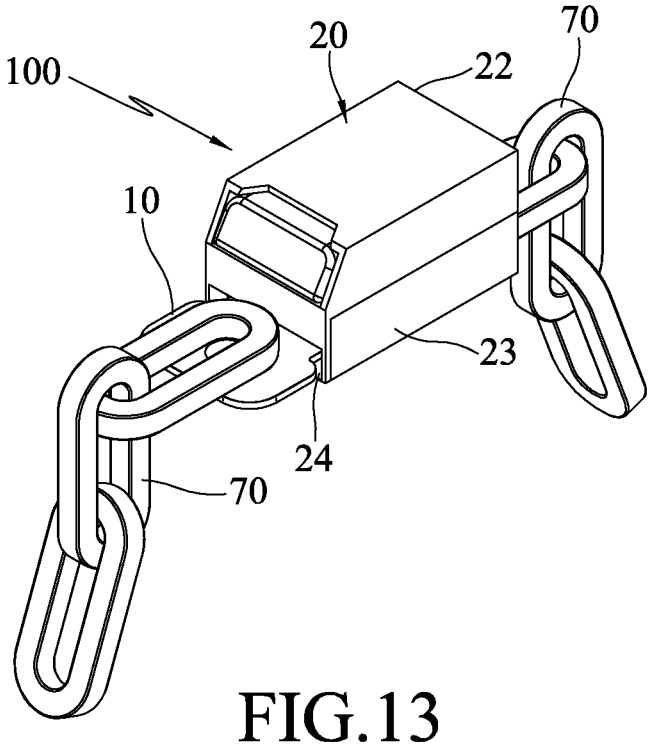
FIG. 13 is a schematic diagram of the use of the buckle lock combined with the connecting piece disclosed in FIG. 12.

As shown in FIG. 12 and FIG. 13, the buckle lock 100 of the present invention can also be used in combination with a connecting piece 70, a first end of the connecting piece 70 is connected to the lock member 10, and a second end of the connecting piece 70 is connected to the buckle base 20 so as to assembly as a bike lock or a belt lock. the connecting piece is selected from a bar, a steel cable or a webbing but also not limited under above. Under above structure, When the locking mechanism 31 is in the locked state, the user can still insert the insert portion 11 of the lock member 10 into the slots 24 of the buckle base 20. After the insert operation is completed, the lock member 10 and the buckle base 20 are locked and connected immediately.

The above are the preferred embodiments of this application, and the scope of protection of this application is not limited accordingly. Therefore: all equivalent changes made in accordance with the structure, shape, and principle of this application shall be covered by the scope of protection of this application inside.

What is claimed is:

1. A buckle lock, comprising:

a lock member having an insert portion;

a buckle base including a lock housing that has a first cover and a second cover, wherein the second cover has an end that defines a slot opening and that is coupled fixedly to the first cover and the buckle base is configured with a slot for receiving the insert portion through the slot opening;

a lock portion having at least one locking mechanism configured on the buckle base, wherein the locking mechanism is changeable between a locked state and an unlocked state; and a release button configured on the buckle base, pushed by a first elastic member to maintain in an ejected position, and pressable to move to a push-down position;

wherein the insert portion of the lock member is able to be inserted into the slot of the buckle base to form a connection, when the locking mechanism is in the unlocked state, the release button is pressed to the push-down position to release the connection between the lock member and the buckle base, and when the locking mechanism is in the locked state, the insert portion can still be inserted into the slot and be locked immediately after completing the insertion action;

a movable latch having a linkage with the release button, pushed by a second elastic member, normally maintained at a lock position for limiting the insert portion, and able to be moved to an unlock position when the insert portion is released; and a positioning block located in the slot, having a linkage with the movable latch, pushed by a third elastic member, kept in a push-out position normally, and movable to a retracted position by connecting the insert portion when the insert portion is inserted in the slot.

2. The buckle lock of claim 1, wherein a hole for limiting the movable latch is configured with the insert portion.

3. The buckle lock of claim 1, wherein when the positioning block is in the push-out position, the movable latch is kept in the unlock position against the positioning block so that when the positioning block is in the retracted position, the movable latch is pushed and moved to the lock position by the second elastic member.

4. The buckle lock of claim 1, wherein the locking mechanism is a combination lock mechanism, when the locking mechanism is in the unlocked state, the release button is pressed to move to the push-down position and the movable latch can be moved to the unlock position in conjunction with the release button.

5. The buckle lock of claim 4, wherein the combination lock mechanism includes a movable plate which has abutting relationship with the release button, when the combination lock mechanism is in the locked state, the movable plate is located at a first position where the release button is not able to be pressed and moved, and when the combination lock mechanism is in an unlocked state, the movable plate moves to a second position that allows the release button to be pressed and moved.

6. The buckle lock of claim 1, wherein the locking mechanism is a key lock mechanism, the key lock mechanism includes a cam portion that has a linkage with the movable latch, and when the key lock mechanism changes from the locked state to the unlocked state, the cam portion will move accordingly and the movable latch will moved from the lock position to the unlock position.

7. The buckle lock of claim 1, further comprising a connecting piece, wherein a first end of the connecting piece is connected to the lock member, and a second end of the connecting piece is connected to the buckle base.

8. The buckle lock of claim 7, wherein the connecting piece is selected from a bar, a steel cable or a webbing.

9. A buckle lock comprising:

a lock member having an insert portion;

a buckle base including a lock housing that has a first cover and a second cover, wherein the second cover has an end that defines a slot opening and that is coupled fixedly to the first cover and the buckle base is configured with a slot for receiving the insert portion through the slot opening;

a lock portion having at least one locking mechanism configured on the buckle base, wherein the locking mechanism is changeable between a locked state and an unlocked state; and a release button configured on the buckle base, pushed by a first elastic member to maintain in an ejected position, and pressable to move to a push-down position, wherein the insert portion of the lock member is able to be inserted into the slot of the buckle base to form a connection, when the locking mechanism is in the unlocked state, the release button is pressed to the push-down position to release the connection between the lock member and the buckle base, and when the locking mechanism is in the locked state, the insert portion can still be inserted into the slot and be locked immediately after completing the insertion action; and a movable latch having a linkage with the release button, pushed by a second elastic member, normally maintained at a lock position for limiting the insert portion, and able to be moved to an unlock position when the insert portion is released, wherein the locking mechanism is a key lock mechanism, the key lock mechanism includes a cam portion that has a linkage with the movable latch, and when the key lock mechanism changes from the locked state to the unlocked state, the cam portion moves accordingly and the movable latch moves from the lock position to the unlock position.

* * * * *